US010309171B1

(12) United States Patent
He et al.

(10) Patent No.: US 10,309,171 B1
(45) **Date of Patent: *Jun. 4, 2019**

(54) COILED TUBING REEL AND COILED TUBING VEHICLE

(71) Applicant: JIANGHAN MACHINERY RESEARCH INSTITUTE LIMITED COMPANY OF CNPC, Jingzhou Hubei (CN)

(72) Inventors: Huiqun He, Wuhan Hubei (CN); Shoujun Liu, Wuhan Hubei (CN); Gao Yang, Wuhan Hubei (CN); Jun Hao, Wuhan Hubei (CN); Qing Ma, Wuhan Hubei (CN); Ge Xiong, Wuhan Hubei (CN); Dafei Wu, Wuhan Hubei (CN); Wencai Yuan, Wuhan Hubei (CN); Zhiguo Song, Wuhan Hubei (CN); Fuqiang Zhang, Wuhan Hubei (CN); Shibin Zhang, Wuhan Hubei (CN); Pingguo Liu, Wuhan Hubei (CN)

(73) Assignee: JIANGHAN MACHINERY RESEARCH INSTITUTE LIMITED COMPANY OF CNPC (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/140,024

(22) Filed: Sep. 24, 2018

(51) Int. Cl.

| | |
|---|---|
| ***B65H 75/14*** | (2006.01) |
| ***B65H 75/30*** | (2006.01) |
| ***E21B 19/22*** | (2006.01) |

(52) U.S. Cl.
CPC ..... *E21B 19/22* (2013.01); *B65H 75/14* (2013.01); *B65H 75/30* (2013.01);
(Continued)

(58) Field of Classification Search
CPC ..... E21B 19/22; B65H 2701/33; B65H 75/40; B65H 75/403
See application file for complete search history.

(56) References Cited

U.S. PATENT DOCUMENTS

2003/0071160 A1* 4/2003 Cain ..... B65H 75/14 242/390.5
2004/0244993 A1* 12/2004 Crawford ..... E21B 15/00 166/381

FOREIGN PATENT DOCUMENTS

CN 103711448 A 4/2014

* cited by examiner

*Primary Examiner* — James G Sayre
(74) *Attorney, Agent, or Firm* — Calfee, Halter & Griswold LLP

(57) ABSTRACT

The present invention relates to the field of petroleum extraction equipment, and discloses a coiled tubing reel and a coiled tubing vehicle. The coiled tubing reel comprises a reel body assembly configured to wind a coiled tubing and a driving component configured to drive the reel body assembly, wherein, the reel body assembly comprises a reel body, a reel shaft, a transmission gear, and a first bearing block and a second bearing block that are oppositely arranged and spaced from each other, wherein the reel body is fixedly fitted on the reel shaft, the two ends of the reel shaft are rotatably arranged on the first bearing block and the second bearing block respectively, the transmission gear is fixed with respect to the reel shaft to drive the reel shaft to rotate, the driving component is fixedly arranged on the first bearing block and at least partially disposed inside the reel body, and the driving component comprises a driving gear that is engaged with the transmission gear. The coiled tubing reel and coiled tubing vehicle provided in the present invention can increase the coiled tubing winding capacity, provide high transmission torque, and operate smoothly and
(Continued)

steadily at a low speed, while meeting the requirement for transportation dimension.

12 Claims, 5 Drawing Sheets

(52) U.S. Cl.
CPC .... *B65H 2403/40* (2013.01); *B65H 2403/725* (2013.01); *B65H 2701/33* (2013.01)

COILED TUBING REEL AND COILED TUBING VEHICLE

FIELD OF THE INVENTION

The present invention relates to the field of petroleum extraction equipment, particularly to a coiled tubing reel and a coiled tubing vehicle.

BACKGROUND OF THE INVENTION

As the coiled tubing technology is developed continuously, the demand for applying the coiled tubing technology in deep well and extra-deep well operations becomes more and more urgent and frequent. Halliburton has utilized variable outer diameter coiled tubing technique to improve the maximum vertical depth of operation to 10,000 m or above; Schlumberger and other companies have many success cases of coiled tubing operation in deep wells and extra-deep wells in depth greater than 6,000 m. However, the reels used by those companies for deep-well large-diameter coiled tubing operation are ultra-large, ultra-wide, and ultra-high. For example, the outer diameter of a reel for coiled tubing in 2" outer diameter with 7,600 m capacity is as large as 4.5 m. Such coiled tubing reels can't be transported successfully under the limited road conditions in China.

In addition, compared with small reels or large reels without limited structural dimensions, extra-deep well coiled tubing reels involve many problems in terms of driving, owing to the high strength grade, large pipe diameter, great wall thickness, great length, heavy weight, and limited structural dimensions of coiled tubing wound on the coiled tubing reels; specifically, the existing reels for coiled tubing operation usually use two driving modes, wherein, one driving mode is a directly driving structure using a motor reducer, but the torque transferred in this driving mode is low and can't meet the winding requirement; the other driving mode is to use chain transmission structure with a motor reducer, but the structural dimensions are large, the transmission is not steady, and the chain may be worn easily.

Therefore, there is a demand for a coiled tubing reel that can increase the coiled tubing winding capacity, provides high transmission torque, and operates smoothly and steadily at a low speed, while meeting the requirement for transportation dimensions.

SUMMARY OF THE INVENTION

To overcome the drawbacks of low coiled tubing winding capacity, low transmission torque, and unsteady transmission in existing coiled tubing reels in the prior art while meeting the requirement for transportation dimensions, one object of the present invention is to provide a coiled tubing reel, which can increase the coiled tubing winding capacity, provides high transmission torque, and operates smoothly and steadily at a low speed while meeting the requirement for transportation dimensions.

Another object of the present invention is to provide a coiled tubing vehicle that includes the coiled tubing reel described above.

To attain the objects described above, in one aspect, the present invention provides a coiled tubing reel, which comprises a reel body assembly configured to wind a coiled tubing and a driving component configured to drive the reel body assembly, wherein, the reel body assembly comprises a reel body, a reel shaft, a transmission gear, and a first bearing block and a second bearing block that are oppositely arranged and spaced from each other, wherein the reel body is fixedly fitted on the reel shaft, the two ends of the reel shaft are rotatably arranged on the first bearing block and the second bearing block respectively, the transmission gear is fixed with respect to the reel shaft to drive the reel shaft to rotate, the driving component is fixedly arranged on the first bearing block and is at least partially disposed inside the reel body, and the driving component comprises a driving gear that is engaged with the transmission gear.

In the technical scheme described above, since the transmission gear is fixed with respect to the reel shaft to drive the reel shaft to rotate, the driving component comprises a driving gear engaged with a transmission gear, and the driving component is fixedly arranged on the first bearing block and at least partially disposed inside the reel body, such that the coiled tubing reel has a compact structure and is small in size, the width of the reel body in the axial direction can be increased while the requirement for transportation dimensions is met, and thereby the coiled tubing winding capacity can be increased; besides, since a gear driving mode is used, the transmission torque is high, and the coiled tubing reel can operate smoothly and steadily at a low speed.

In a second aspect, the present invention provides a coiled tubing vehicle, which comprises a vehicle body and the above-mentioned coiled tubing reel mounted on the vehicle body, wherein the first bearing block and the second bearing block are fixed with respect to the vehicle body respectively.

Other features and advantages of the present invention will be further detailed in the embodiments hereunder.

BRIEF DESCRIPTION OF DRAWINGS

The accompanying drawings are provided here to facilitate further understanding on the present invention, and constitute a part of this document. They are used in conjunction with the following embodiments to explain the present invention, but shall not be comprehended as constituting any limitation to the present invention. In the figures.

BRIEF DESCRIPTION OF SYMBOLS

Figure 1:
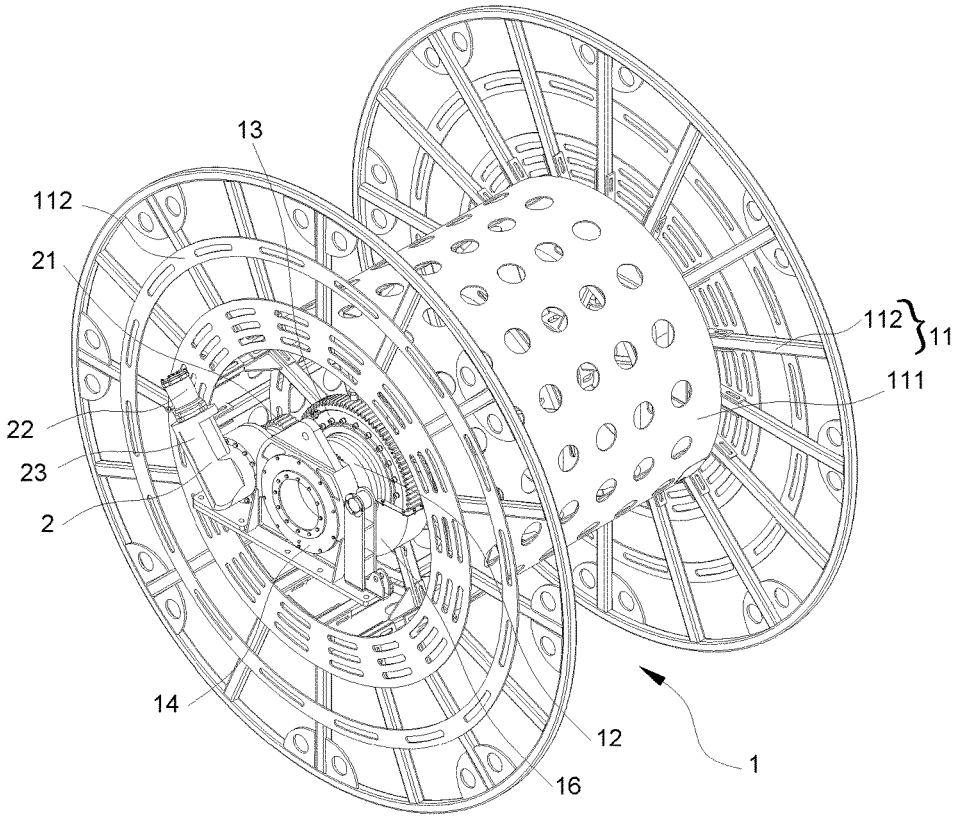
FIG. 1 is a schematic diagram of a part of the structure of the coiled tubing reel in a preferred embodiment of the present invention.

1—reel body assembly; 11—reel body; 111—reel support; 1111—annular cylinder; 1112—radial column; 1113— axial column; 1114—circumferential column; 112—spoke wheel; 12—reel shaft; 13—transmission gear; 14—first bearing block; 15—second bearing block; 16—housing; 2—driving component; 21—driving gear; 22—motor; 23—reducer; 3—frame-shaped base; 4—braking component; 41—mounting base; 42—slide block; 43—friction disk; 44—screw rod; 45—supporting member; 46—lock nut; K—dovetail block; 47—stopper; T—flange; 5—tubing aligner assembly; 51—first linking arm; 52—second linking arm; 53—rhombic shaft; 54—first sprocket; 55—second sprocket; 56—forced alignment motor; 57—slide tongue box assembly; 58—roller bogie; 59—adjustable counter; 50—lubricant box; 6—clutch component; 61—driving portion; 611—driving shaft; 612—driving sprocket; 62—driven portion; 621—driven shaft; 622—driven sprocket; 63—clutch portion; 64—switching portion; 7—elevating component; 8—hoisting component; 9—container locking base; P1—internal manifold; P2—external manifold; F—check valve.

DETAILED DESCRIPTION OF THE EMBODIMENTS

Hereunder some embodiments of the present invention will be detailed with reference to the accompanying drawings. It should be understood that the embodiments described here are only provided to describe and explain the present invention, but shall not be deemed as constituting any limitation to the present invention.

In the present invention, unless otherwise specified, the terms that denote the orientations are used as follows, for example: "top", "bottom", "left" and "right" usually refer to "top", "bottom", "left" and "right" as shown in the accompanying drawings; "inside" and "outside" refer to inside and outside in relation to the profiles of the components.

In one aspect, the present invention provides a coiled tubing reel, which comprises a reel body assembly 1 configured to wind a coiled tubing and a driving component 2 configured to drive the reel body assembly 1, wherein, the reel body assembly 1 comprises a reel body 11, a reel shaft 12, a transmission gear 13, and a first bearing block 14 and a second bearing block 15 that are oppositely arranged and spaced from each other, wherein the reel body 11 is fixedly fitted on the reel shaft 12, the two ends of the reel shaft 12 are rotatably arranged on the first bearing block 14 and the second bearing block 15 respectively, the transmission gear 13 is fixed with respect to the reel shaft 12 to drive the reel shaft 12 to rotate, the driving component 2 is fixedly arranged on the first bearing block 14 and is at least partially disposed inside the reel body 11, and the driving component 2 comprises a driving gear 21 that is engaged with the transmission gear 13, and preferably, the driving component 2 further comprises a motor 22 and a reducer 23 that is connected between the motor 22 and the driving gear 21 and fixedly arranged on the first bearing block 14, and at least a part of the structure of the reducer 23 is disposed inside the reel body 11. In addition, the driving component 2 may be fixedly connected to the first bearing block 14 by bolts.

In the technical scheme described above, as shown in FIG. 1, since the transmission gear 12 is fixed with respect to the reel shaft 12 to drive the reel shaft 12 to rotate, the driving component 2 comprises a driving gear 21 engaged with a transmission gear 13, and the driving component 2 is fixedly arranged on the first bearing block 14 and at least partially disposed inside the reel body 11, such that the coiled tubing reel has a compact structure and is small in size, the width of the reel body 11 in the axial direction can be increased while the requirement for transportation dimensions is met, and thereby the coiled tubing winding capacity can be increased; besides, since a gear driving mode is used, the transmission torque is high, the coiled tubing reel can operate smoothly and steadily at a low speed, and the reel body 11 can be replaced conveniently.

Figure 4:
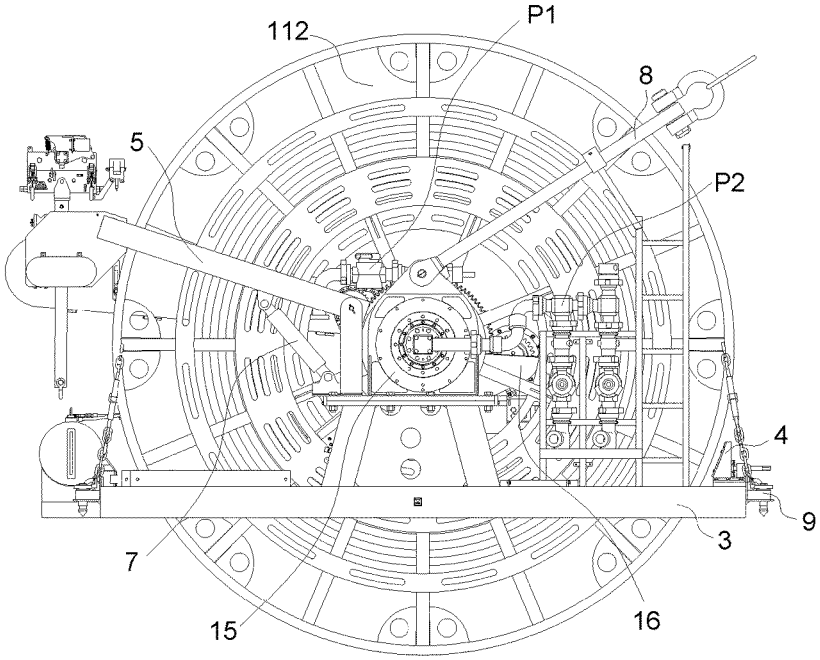
FIG. 4 is a right view of the coiled tubing reel in the preferred embodiment of the present invention.

In view that the transmission gear 13 is large in size and it is inconvenient to directly fix the transmission gear 13 to the reel shaft 12, preferably, the reel body assembly 1 comprises a flange that is fixedly fitted on the reel shaft 12 and fixedly connected to the reel body 11, so that the transmission gear 13 can be fixed with respect to the reel shaft 12 conveniently. The flange may be connected to the gear shaft 12 and the reel body 11 (e.g., radial columns 1112 described below) by welding, the transmission gear 13 may be fitted on the reel shaft 12 and fixedly connected to the flange. For example, the transmission gear 13 may be fixedly connected to the flange by bolts. In addition, to reduce the wear between the driving gear 21 and the transmission gear 13 and make the transmission more smooth and steady, as shown in FIGS. 1 and 4, the reel body assembly 1 further comprises an housing 16 outside the driving gear 21 and the transmission gear 13, wherein the housing 16 accommodates lubricant inside it and is fixed with respect to the first bearing block 14, and the housing 16 has an opening; the diameter of the flange is smaller than the diameter of the transmission gear 13, the flange extends out from the opening, and there is clearance between the flange and the opening. In that way, the flange can rotate together with the reel shaft 12, while the housing 16 doesn't rotate together with the reel shaft 12.

Figure 2:
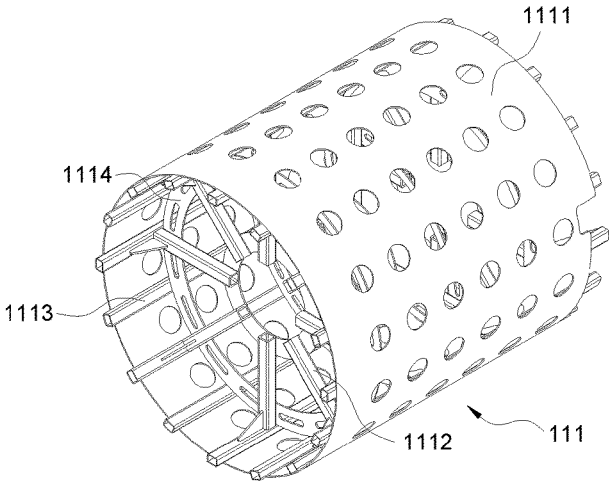
FIG. 2 is a schematic structural diagram of the reel support in the preferred embodiment of the present invention.

Furthermore, to fixedly connect the flange to the reel body 11 conveniently and reduce the weight of the reel body 11 so as to increase the weight of wound coiled tubing, as shown in FIGS. 1 and 2, preferably, the reel body 11 comprises a reel support 111 configured to wind the coiled tubing and spoke wheels 112 arranged on the two ends of the reel support 111, the reel support 111 comprises an annular cylinder 1111 and a plurality of radial columns 1112 that are arranged at an interval in the circumferential direction of the annular cylinder 1111 and extends in the radial direction of the annular cylinder 1111, the two ends of each radial column 1112 are fixedly connected to the annular cylinder 1111 and the reel shaft 12 respectively, and the flange is fixedly connected to the radial columns 1112. Here, it should be noted: since the driving gear 21 and the transmission gear 13 require lubrication with lubricant during their operation, usually the above-mentioned housing 16 that accommodates lubricant is arranged outside the driving gear 21 and the transmission gear 13. Consequently, the transmission gear 13 can't be directly connected to the radial columns 1112 by welding; instead, a space for mounting the housing 16 has to be reserved. Therefore, the transmission gear 13 may be indirectly connected to the radial columns 1112 via the above-mentioned flange. In addition, to ensure the structural strength of the reel support 111, the reel support 111 further comprises a plurality of axial columns 1113 that are arranged at an interval in the circumferential direction of the annular cylinder 1111 and extend in the axial direction of the annular cylinder 1111 and/or a plurality of circumferential columns 1114 that are arranged at an interval in the axial direction of the annular cylinder 1111 and extend in the circumferential direction of the annular cylinder 1111. Wherein, the circumferential columns 1114 may be in an annular shape, and the radial columns 1112, axial columns 1113, and circumferential columns 1114 may be made of square steel.

Figure 3:
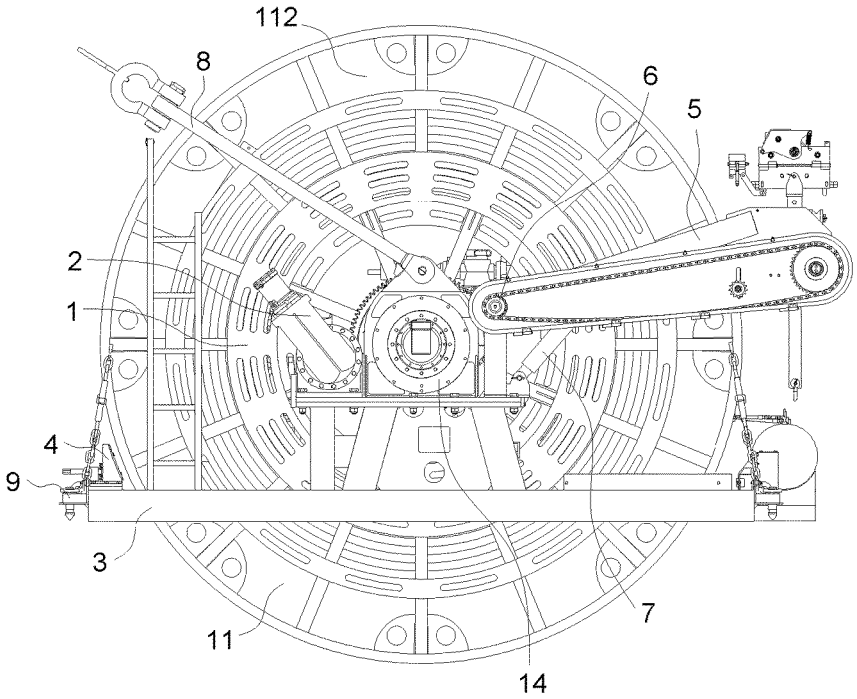
FIG. 3 is a left view of the coiled tubing reel in the preferred embodiment of the present invention.

To further increase the coiled tubing winding capacity of the reel body 11, as shown in FIGS. 3 and 4, preferably, the coiled tubing reel comprises a frame-shaped base 3, the reel body 11 is fitted inside the frame-shaped base 3, and the first bearing block 14 and the second bearing block 15 are arranged on two opposite side edges of the frame-shaped base 3. When the coiled tubing reel is mounted on a vehicle body for transportation, the frame-shaped base 3 may be directly fixed to the vehicle body. For example, the frame-shaped base 3 may be fixed to a trailer by means of a container locking base 9. In addition, the vehicle body may have a space for accommodating the part of the reel body 11 below the frame-shaped base 3 (at the side away from the reel shaft 12), and thereby the height of the reel body 11 on which the coiled tubing is wound can be decreased, which is to say, the coiled tubing winding capacity of the reel body 11 can be increased. Moreover, to mount the reel body assembly 1 on the vehicle body conveniently, a hoisting component 8 may be mounted on the reel body 11, and the two ends of the hoisting component 8 may be hinged via a pin shaft to the first bearing block 14 and the second bearing block 15 respectively. Besides, as shown in FIG. 4, an internal manifold P1 configured to connect the coiled tubing and an external manifold P2 configured to connect an external pump truck may be arranged on the second bearing block 15.

The reel body 11 may produce high rotational inertia impact under road conditions in the transportation process of the coiled tubing reel, and, if chain tighteners are used to fix the reel body 11, the chains and hangers of the chain tighteners may be deformed or broken easily, and consequently the reel body 11 can't be fixed reliably. In view of that problem, to fix the reel body 11 reliably, as shown in FIGS. 1, 2, 3, and 4, preferably, the reel body 11 comprises a reel support 111 configured to wind the coiled tubing and spoke wheels 112 arranged on the two ends of the reel support 111, and the coiled tubing reel comprises braking component 4 that are arranged on the frame-shaped base 3 at the sides of the reel body 11 and capable of coming into contact with the spoke wheels 112 to restrain the movement of the reel body 11. Moreover, to keep the reel body 11 in a balanced stress state, braking components 4 may be arranged at the same side of the reel body 11 near the two spoke wheels 112 respectively.

Figure 5:
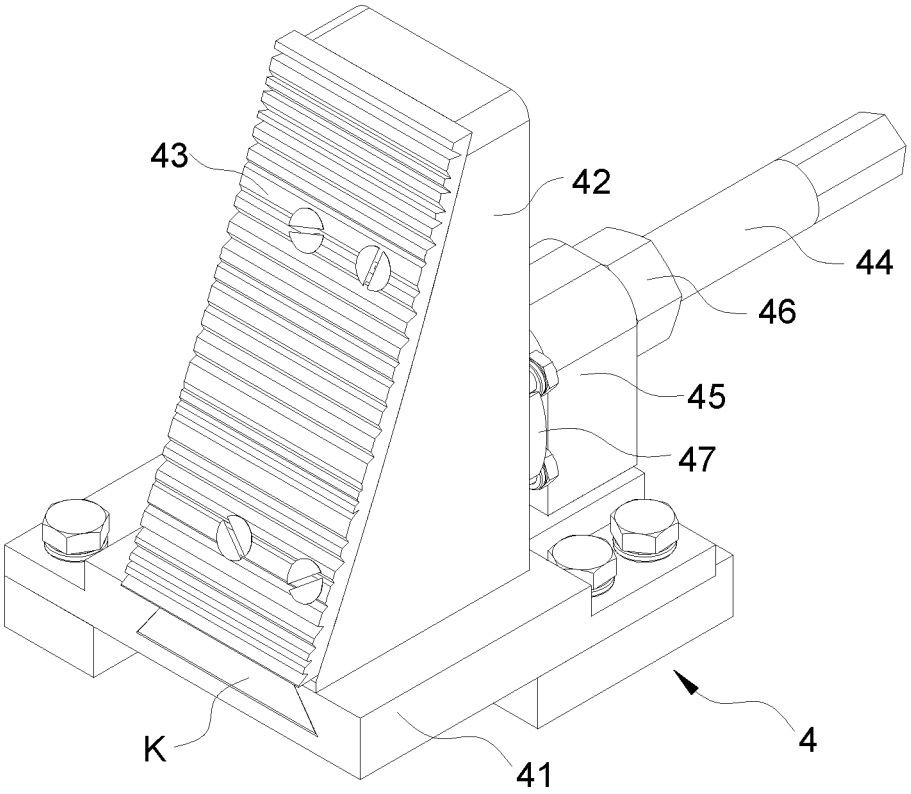
FIG. 5 is a schematic structural diagram of the braking component in the preferred embodiment of the present invention.

Wherein, preferably, as shown in FIG. 5, the braking component 4 comprises a mounting base 41, a slide block 42, a friction disk 43, a screw rod 44, and a supporting member 45 fixed with respect to the mounting base 41 (e.g., the supporting member 45 may be fixed to the mounting base 41), wherein the mounting base 41 is fixedly connected to the frame-shaped base 3, a slide track structure extending in the axial direction of the screw rod 44 is arranged between the slide block 42 and the mounting base 41, the friction disk 43 is arranged on the side of the slide block 42 that faces the spoke wheel 112, one end of the screw rod 44 is axially limited on the side of the slide block 42 that is opposite to the spoke wheel 112 and capable of rotating with respect to the slide block 42, and the other end of the screw rod 44 is fitted in the supporting member 45 via threads; moreover, to keep the friction disk 43 in a required position reliably, the braking component 4 further comprises a lock nut 46 arranged on the screw rod 44 at the side of the supporting member 45 away from the slide block 42. In that way, to restrain the rotation of the reel body 11, the screw rod 44 may be turned with a wrench, so that the slide block 42 and the friction disk 43 move with respect to the mounting base 41 in the extension direction of the slide track structure (i.e., the axial direction of the screw rod 44) to a position where the friction disk 43 firmly abut against the periphery of the spoke wheel 112, and then the lock nut 46 on the screw rod 44 can be tightened up, i.e., the lock nut 46 comes into contact with the supporting member 45 to prevent sliding of the slide block 42 during transportation; to enable the reel body 11 to rotate normally, the screw rod 44 may be turned with a wrench in a direction in which the friction disk 43 moves away from the spoke wheel 112 to a position where the friction disk 43 doesn't interfere with the spoke wheel 112, and then the lock nut 46 can be tightened up, so as to prevent the slide block 42 from sliding with respect to the mounting base 41 and thereby interfering with the spoke wheel 112.

Furthermore, to increase the contact area between the mounting base 41 and the slide block 42 and enable the mounting base 41 and the slide block 42 to be in slide-fit with each other reliably via the slide track structure, as shown in FIG. 5, preferably, the slide track structure comprises a dovetail groove arranged in the mounting base 41 and a dovetail block K that is arranged on the slide block 42 and is in slide-fit with the dovetail groove.

Figure 6:
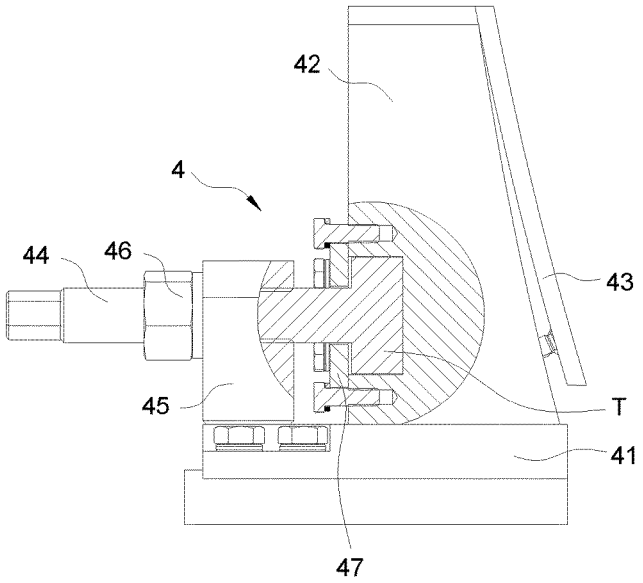
FIG. 6 is a broken-out sectional view of the braking component in the preferred embodiment of the present invention.

In addition, to enable one end of the screw rod 44 to be limited inside the slide block 42 in the axial direction and rotate with respect to the slide block 42, as shown in FIG. 6, preferably, the braking component 4 comprises a stopper 47, the slide block 42 is provided with an accommodating cavity, a flange T is arranged on the end of the screw rod 44 and rotatably disposed inside the accommodating cavity, the stopper 47 is fixedly connected to the slide block 42 and stops the flange T inside the accommodating cavity. Wherein, the stopper 47 may comprise a cover plate and fasteners that fixedly connect the cover plate to the slide block 42. Specifically, the fasteners may be screws.

Figure 7:
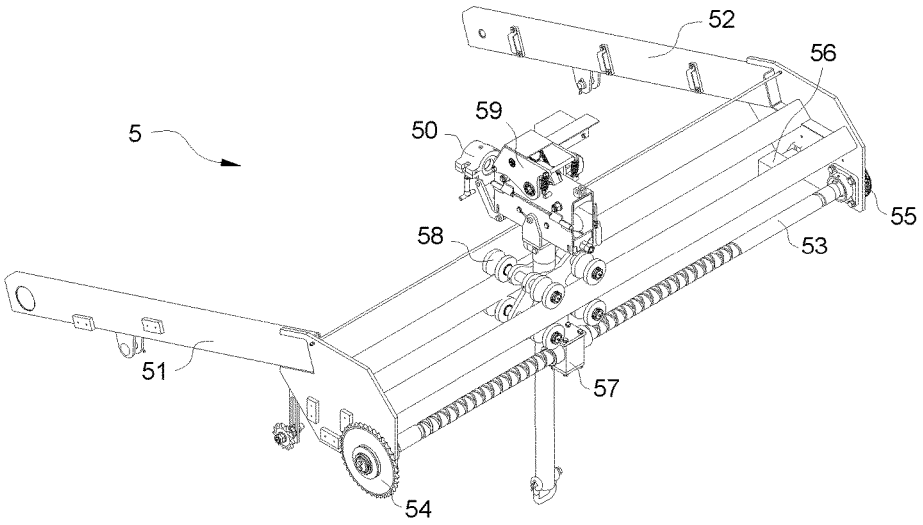
FIG. 7 is a schematic structural diagram of the tubing aligner assembly in the preferred embodiment of the present invention.

As shown in FIGS. 3, 4, and 7, preferably, the coiled tubing reel comprises a tubing aligner (level wind) assembly 5 and a clutch component 6 fixedly connected to the first bearing block 14, wherein the tubing aligner assembly 5 comprises a first linking arm 51 and a second linking arm 52 that are oppositely arranged and a rhombic shaft 53 with two ends rotatably fitted with the first linking arm 51 and the second linking arm 52 respectively, the end of the first linking arm 51 that is away from the rhombic shaft 53 is rotatably fitted on the clutch component 6, the end of the second linking arm 52 that is away from the rhombic shaft 53 is hinged to the second bearing block 15, and the clutch component 6 is capable of moving the rhombic shaft 53 and the reel shaft 12 in association or not. In that way, automatic tubing alignment can be realized when the rhombic shaft 53 and the reel shaft 12 are in association via the clutch component 6; in a case that the coiled tubing is not aligned orderly, the rhombic shaft 53 and the reel shaft 12 may be not in association via the clutch component 6 so that a forced alignment motor 56 described below may be used to align the coiled tubing forcibly, to ensure the coiled tubing is aligned orderly and a required amount of coiled tubing can be wound on the reel body 11.

Figure 8:
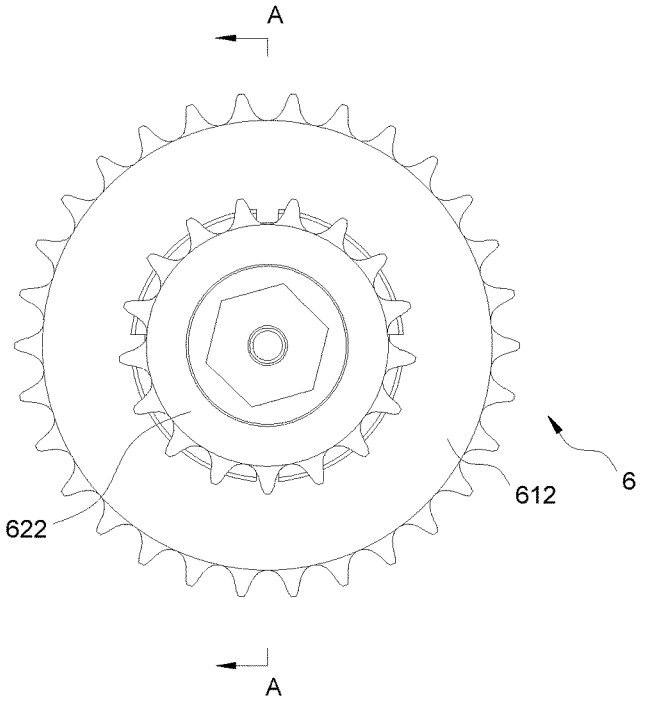
FIG. 8 is a schematic structural diagram of the clutch component in the preferred embodiment of the present invention.
Figure 9:
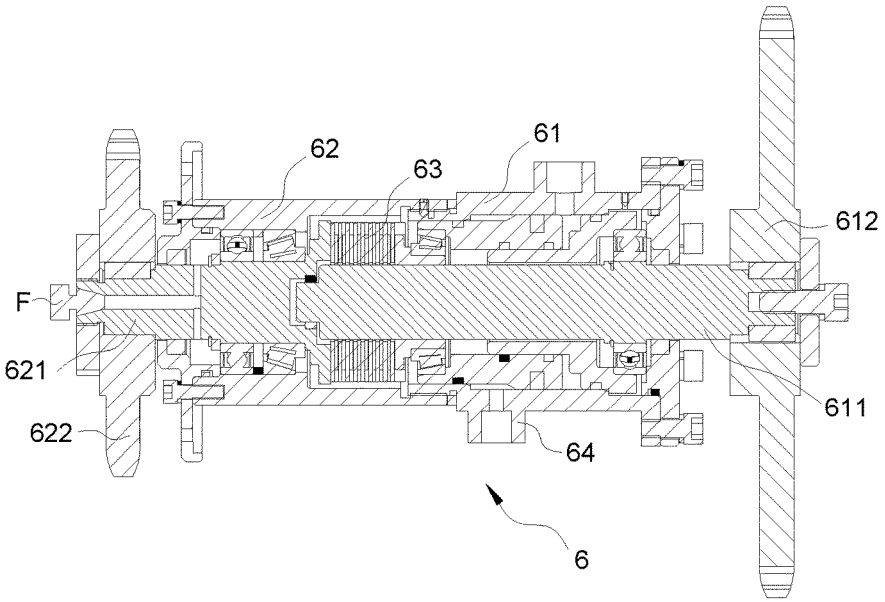
FIG. 9 is a sectional view A-A of the structure shown in FIG. 8.

Usually a mechanical overrun clutch is used for switchover between automatic tubing alignment and forced tubing alignment in coiled tubing reels at present. Such friction clutch controls the magnitude of the generated friction moment by means of the amount of compression of a Belleville spring, and the friction moment is greater than the moment required to drive the rhombic shaft 53 of the tubing aligner assembly 5 to rotate and smaller than the driving moment of the forced alignment motor 56. The amount of compression of the Belleville spring is adjusted by means of a bolt, but the bolt may get loose and the friction disk may be worn during use. Therefore, manual adjustment is often required. However, field adjustment is inconvenient and unsafe, and the magnitude of the friction moment is difficult to control. Especially, for high-strength large-diameter coiled tubing used in deep wells, it is more difficult to control the friction moment. Hence, it is desirable to develop a clutch component 6 applicable to alignment of high-strength coiled tubing. As shown in FIGS. 8 and 9, preferably, the clutch component 6 in the present application comprises a driving portion 61, a driven portion 62, and a clutch portion 63 that has an engaged state in which the driving portion 61 is engaged with the driven portion 62 and a disengaged state in which the driving portion 61 is disengaged from the driven portion 62, wherein the clutch portion 63 may be arranged between the driving portion 61 and the driven portion 62, the driving portion 61 is in a transmission connection with the reel shaft 12, the driven portion 62 is in a transmission connection with the rhombic shaft 53, and the clutch component 6 further comprises a switching portion 64 configured to control the clutch component 6 to switch between the engaged state and the disengaged state. Wherein, the switching portion 64 may be connected to a hydraulic control system, and the hydraulic control system control the clutch portion 63 to switch to the engaged state in which the driving portion 61 is engaged with the driven portion 62 or to the disengaged state in which the driving portion 61 is disengaged from the driven portion 62 through hydraulic action on the switching portion 64.

Further preferably, the driving portion 61 comprises a driving shaft 611 and a driving sprocket 612 mounted on the driving shaft 611; for example, the driving sprocket 612 is fitted on an outer end of the driving shaft 611 that is away from the driven portion 62, an end plate in diameter greater than the diameter of the driving shaft 611 may be mounted on the outer end of the driving shaft 611, and the end plate is fixedly connected to the driving shaft 611 by bolts to prevent the driving sprocket 612 from sliding off the driving shaft 611; the reel shaft 12 is provided with a transmission sprocket, and the driving sprocket 611 is connected to the transmission sprocket via chain; the driven portion 62 comprises a driven shaft 621 and a driven sprocket 622 mounted on the driven shaft 621; for example, the driven sprocket 622 is fitted on the outer end of the driven shaft 621 that is away from the driving portion 61, an end plate in diameter greater than the diameter of the driven shaft 621 may be fitted on the outer end of the driven shaft 621 via threads to prevent the driven sprocket 622 from sliding off the driven shaft 621, a hole in communication with the clutch portion 63 for lubricant flow may be arranged in the end surface of the outer end of the driven shaft 621, and the hole may be sealed by means of a check valve F; the tubing aligner assembly 5 comprises a first sprocket 54 and a second sprocket 55 that are fixedly connected to the two ends of the rhombic shaft 53 respectively, and the driven sprocket 621 is connected to the first sprocket 54 via chain; the tubing aligner assembly 5 is provided with a forced alignment motor 56, and the forced alignment motor 56 is connected to the second sprocket 55 via chain. In addition, a slide tongue box assembly 57 is fitted on the rhombic shaft 53, a roller bogie 58 is fixedly connected on the slide tongue box assembly 57, the first linking arm 51 and the second linking arm 52 are provided with slide tracks that extend in the same direction as the rhombic shaft 53 to guide the roller bogie 58 to slide, and an adjustable counter 59 and a lubricant box 50 are mounted on the roller bogie 58. Quick switchover between automatic tubing alignment and manual forced tubing alignment can be realized via the clutch component 6, and thereby manual adjustment can avoided, adjustment time can be reduced, labor intensity can be decreased, and operation convenience, safety and reliability can be improved.

As shown in FIGS. 3 and 4, preferably, an elevating component 7 configured to elevate the tubing aligner assembly 5 is arranged between the first linking arm 51 and the first bearing block 14 and between the second linking arm 52 and the second bearing block 15 respectively. Wherein, the elevating component 7 may be connected to one of the first linking arm 51, the first bearing block 14, the second linking arm 52, and the second bearing block 15, and the elevating component 7 may be a hydraulic cylinder.

The operating process of the coiled tubing reel in the present invention is as follows: the hydraulic motor 22 is driven by hydraulic power (i.e., supplied by a power system) to drive the driving gear 21 via the reducer 23 to rotate, the driving gear 21 is engaged with the transmission gear 13 that is fixed with respect to the reel shaft 12 and thereby drives the reel body 11 that is fixedly fitted on the reel shaft 12 to rotate; in the case of automatic tubing alignment, the driven portion 62 and the driving portion 61 of the clutch component 6 are driven by the hydraulic power at the same time to engage with each other via the clutch portion 63 (i.e., the clutch portion 63 is in an engaged state), the reel shaft 12 rotates and drives the transmission sprocket on it to rotate, the transmission sprocket drives the driving sprocket 612 on the driving shaft 611 via chain to rotate and drive the driven shaft 621 and the driven sprocket 622 on the driven shaft 621 to rotate together, the driven sprocket 622 drives the first sprocket 54 via chain to rotate, and thereby the rhombic shaft 53 rotates, so that the slide tongue box assembly 57 and the roller bogie 58 move to and fro along the length direction of the rhombic shaft 53, and drive the coiled tubing mounted on the adjustable counter 59 to align uniformly on the reel body 11. In the case that the coil tubing is not aligned orderly, the clutch component 6 is driven by hydraulic power to drive the driven shaft 621 and the driving shaft 611 to disengage from each other via the clutch portion 63; now the driving sprocket 612 and the driven sprocket 622 are not in association with each other; then, the forced alignment motor 56 on the tubing aligner assembly 5 is driven by hydraulic power to drive the second sprocket 55 and the rhombic shaft 53 to rotate, so that the slide tongue box assembly 57 and the roller bogie 58 are driven to move to and fro in the length direction of the rhombic shaft 53; after the coil tubing is aligned orderly, the rotation of the forced alignment motor 56 is stopped, and the clutch component 6 is driven by hydraulic power to drive the driven shaft 621 and the driving shaft 611 to engage with each other via the clutch portion 63, and thereby automatic tubing alignment is enabled.

In a second aspect, the present invention provides a coiled tubing vehicle, which comprises a vehicle body and the above-mentioned coiled tubing reel mounted on the vehicle body, wherein the first bearing block 14 and the second bearing block 15 are fixed with respect to the vehicle body respectively. Since the coiled tubing vehicle includes the above-mentioned coiled tubing reel, it has all or at least a part of the technical effects of the coiled tubing reel. Please see the above description for the details and effects of the specific technical scheme.

While the present invention is described above in detail in some preferred embodiments with reference to the accompanying drawings, the present invention is not limited to those embodiments. Various simple variations may be made to the technical scheme in the present invention, including combinations of the specific technical features in any appropriate form, within the scope of the technical ideal of the present invention. To avoid unnecessary repetition, the possible combinations are not described specifically in the present invention. However, such simple variations and combinations shall also be deemed as having been disclosed in the present invention and falling in the scope of protection of the present invention.

The invention claimed is:

1. A coiled tubing reel, comprising a reel body assembly (1) configured to wind a coiled tubing and a driving component (2) configured to drive the reel body assembly (1), wherein, the reel body assembly (1) comprises a reel body (11), a reel shaft (12), a transmission gear (13), and a first bearing block (14) and a second bearing block (15) that are oppositely arranged and spaced from each other, wherein the reel body (11) is fixedly fitted on the reel shaft (12), the two ends of the reel shaft (12) are rotatably arranged on the first bearing block (14) and the second bearing block (15) respectively, the transmission gear (13) is fixed with respect to the reel shaft (12) to drive the reel shaft (12) to rotate, the driving component (2) is fixedly arranged on the first bearing block (14) and is at least partially disposed inside the reel body (11), and the driving component (2) comprises a driving gear (21) that is engaged with the transmission gear (13), the reel body assembly (1) comprises a flange that is fixedly fitted on the reel shaft (12) and fixedly connected to the reel body (11), and the transmission gear (13) is fitted on the reel shaft (12) and fixedly connected to the flange; the reel body assembly (1) further comprises a housing (16) that is arranged outside the driving gear (21) and the transmission gear (13); the housing (16) accommodates lubricant in it and is fixed with respect to the first bearing block (14), and the housing (16) has an opening, the flange extends out from the opening, and there is clearance between the flange and the opening.

2. The coiled tubing reel according to claim 1, wherein, the reel body (11) comprises a reel support (111) configured to wind the coiled tubing and spoke wheels (112) arranged on the two ends of the reel support (111), the reel support (111) comprises an annular cylinder (1111) and a plurality of radial columns (1112) that are arranged at an interval in the circumferential direction of the annular cylinder (1111) and extend in the radial direction of the annular cylinder (1111), the two ends of each radial column (1112) are fixedly connected to the annular cylinder (1111) and the reel shaft (12) respectively, and the flange is fixedly connected to the radial columns (1112); and/or, the reel support (111) further comprises a plurality of axial columns (1113) that are arranged at an interval in the circumferential direction of the annular cylinder (1111) and extend in the axial direction of the annular cylinder (1111) and/or a plurality of circumferential columns (1114) that are arranged at an interval in the axial direction of the annular cylinder (1111) and extend in the circumferential direction of the annular cylinder (1111).

3. The coiled tubing reel according to claim 1, wherein, the coiled tubing reel comprises a frame-shaped base (3), the reel body (11) is fitted inside the frame-shaped base (3), and the first bearing block (14) and the second bearing block (15) are arranged on two opposite side edges of the frame-shaped base (3).

4. The coiled tubing reel according to claim 3, wherein, the reel body (11) comprises a reel support (111) configured to wind the coiled tubing and spoke wheels (112) arranged on the two ends of the reel support (111), and the coiled tubing reel comprises braking components (4) that are arranged on the frame-shaped base (3) at the sides of the reel body (11) and capable of coming into contact with the spoke wheels (112) to restrain the movement of the reel body (11).

5. The coiled tubing reel according to claim 4, wherein, the braking component (4) comprises a mounting base (41), a slide block (42), a friction disk (43), a screw rod (44), and a supporting member (45) fixed with respect to the mounting base (41), the mounting base (41) is fixedly connected to the frame-shaped base (3), a slide track structure extending in the axial direction of the screw rod (44) is arranged between the slide block (42) and the mounting base (41), the friction disk (43) is arranged on the side of the slide block (42) that faces the spoke wheel (112), one end of the screw rod (44) is axially limited on the side of the slide block (42) that is opposite to the spoke wheel (112) and capable of rotating with respect to the slide block (42), and the other end of the screw rod (44) is fitted in the supporting member (45) via threads; the braking component (4) further comprises a lock nut (46) arranged on the screw rod (44) at the side of the supporting member (45) that is away from the slide block (42).

6. The coiled tubing reel according to claim 5, wherein, the slide track structure comprises a dovetail groove arranged in the mounting base (41) and a dovetail block (K) that is arranged on the slide block (42) and in slide-fit with the dovetail groove.

7. The coiled tubing reel according to claim 5, wherein, the braking component (4) comprises a stopper (47), the slide block (42) is provided with an accommodating cavity, a flange (T) is arranged on an end of the screw rod (44) and rotatably disposed inside the accommodating cavity, the stopper (47) is fixedly connected to the slide block (42) and stops the flange (T) inside the accommodating cavity.

8. The coiled tubing reel according to claim 1, wherein, the coiled tubing reel comprises an tubing aligner assembly (5) and a clutch component (6) fixedly connected to the first bearing block (14), the tubing aligner assembly (5) comprises a first linking arm (51) and a second linking arm (52) that are oppositely arranged and a rhombic shaft (53) with two ends rotatably fitted with the first linking arm (51) and the second linking arm (52) respectively, the end of the first linking arm (51) that is away from the rhombic shaft (53) is rotatably fitted on the clutch component (6), the end of the second linking arm (52) that is away from the rhombic shaft (53) is hinged to the second bearing block (15), and the clutch component (6) is capable of moving the rhombic shaft (53) and the reel shaft (12) in association or not.

9. The coiled tubing reel according to claim 8, wherein, the clutch component (6) comprises a driving portion (61), a driven portion (62), and a clutch portion (63) that has an engaged state in which the driving portion (61) is engaged with the driven portion (62) and a disengaged state in which the driving portion (61) is disengaged from the driven portion (62), wherein the driving portion (61) is in a transmission connection with the reel shaft (12), the driven portion (62) is in a transmission connection with the rhombic shaft (53), and the clutch component (6) further comprises a switching portion (64) configured to control the clutch component (6) to switch between the engaged state and the disengaged state.

10. The coiled tubing reel according to claim 9, wherein, the driving portion (61) comprises a driving shaft (611) and a driving sprocket (612) mounted on the driving shaft (611), the reel shaft (12) is provided with a transmission sprocket, and the driving sprocket (611) is connected to the transmission sprocket via chain; the driven portion (62) comprises a driven shaft (621) and a driven sprocket (622) mounted on the driven shaft (621); the tubing aligner assembly (5) comprises a first sprocket (54) and a second sprocket (55) that are fixedly connected to the two ends of the rhombic shaft (53) respectively, and the driven sprocket (621) is connected to the first sprocket (54) via chain; the tubing aligner assembly (5) is provided with a forced alignment motor (56), and the forced alignment motor (56) is connected to the second sprocket (55) via chain.

11. The coiled tubing reel according to claim 8, wherein, an elevating component (7) configured to elevate the tubing aligner assembly (5) is arranged between the first linking arm (51) and the first bearing block (14) and between the second linking arm (52) and the second bearing block (15) respectively.

12. A coiled tubing vehicle, comprising a vehicle body and the coiled tubing reel according to claim 1 mounted on the vehicle body, wherein the first bearing block (14) and the second bearing block (15) are fixed with respect to the vehicle body respectively.

* * * * *